US011538421B2

(12) United States Patent
Kim et al.

(10) Patent No.: US 11,538,421 B2
(45) Date of Patent: Dec. 27, 2022

(54) DISPLAY DEVICE PERFORMING ADAPTIVE REFRESH

(71) Applicant: Samsung Display Co., Ltd., Yongin-si (KR)

(72) Inventors: Hongsoo Kim, Hwaseong-si (KR); Sehyuk Park, Seongnam-si (KR); Hyo Jin Lee, Yongin-si (KR); Sangan Kwon, Cheonan-si (KR); Jinyoung Roh, Hwaseong-si (KR); Sukhun Lee, Suwon-si (KR); Jun Heyung Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/824,377

(22) Filed: Mar. 19, 2020

(65) Prior Publication Data

US 2020/0410942 A1 Dec. 31, 2020

(30) Foreign Application Priority Data

Jun. 25, 2019 (KR) ..... 10-2019-0075712

(51) Int. Cl.
*G09G 3/3291* (2016.01)

(52) U.S. Cl.
CPC ..... *G09G 3/3291* (2013.01); *G09G 2360/12* (2013.01)

(58) Field of Classification Search
CPC ..... G09G 2340/0435; G09G 2320/103; G09G 2320/0247; G09G 3/3648; G09G 3/3611; G09G 3/36; G09G 3/3696; G09G 3/3618; G09G 2360/18; G09G 2370/08; G09G 5/395; G09G 5/363; G09G 2310/027;
(Continued)

(56) References Cited

U.S. PATENT DOCUMENTS

2008/0136752 A1* 6/2008 Inoue ..... G09G 3/2022 345/77
2009/0322969 A1* 12/2009 Unger ..... G09G 5/003 348/790

(Continued)

FOREIGN PATENT DOCUMENTS

KR 10-1496672 B1 3/2015
KR 10-2015-0055250 A 5/2015
KR 10-2015-0057404 A 5/2015

*Primary Examiner* — Dong Hui Liang
(74) *Attorney, Agent, or Firm* — Lewis Roca Rothgerber Christie LLP

(57) ABSTRACT

A display device includes display device includes: a display panel including a plurality of pixels; a data driver configured to generate data voltages based on output image data, and to provide the data voltages to the plurality of pixels; and a controller configured to receive input image data and input frequency information from a host processor, and to provide the output image data to the data driver, wherein the controller includes an adaptive refresh block configured to: determine a target frequency by analyzing the input image data; determine a masking ratio based on an input frequency represented by the input frequency information and the target frequency; and selectively output the input image data as the output image data by performing a masking operation on the input image data with the masking ratio.

17 Claims, 12 Drawing Sheets

(58) Field of Classification Search
CPC ..... G09G 2310/0254; G09G 2330/021; G09G 2330/02
See application file for complete search history.

(56) References Cited

U.S. PATENT DOCUMENTS

| | | | | |
|---|---|---|---|---|
| 2013/0278614 | A1* | 10/2013 | Sultenfuss | G09G 3/3406 345/520 |
| 2014/0306969 | A1* | 10/2014 | Tang | G09G 5/006 345/520 |
| 2016/0111055 | A1* | 4/2016 | Na | G09G 3/3666 345/212 |
| 2016/0329030 | A1* | 11/2016 | Lee | G06F 3/1446 |
| 2019/0258114 | A1* | 8/2019 | Kwon | H05B 45/12 |

* cited by examiner

DISPLAY DEVICE PERFORMING ADAPTIVE REFRESH

CROSS-REFERENCE TO RELATED APPLICATION(S)

The present application claims priority to and the benefit of Korean Patent Application No. 10-2019-0075712, filed on Jun. 25, 2019 in the Korean Intellectual Property Office (KIPO), the entire content of which is incorporated herein in its entirety by reference.

BACKGROUND

1. Field

Aspects of some example embodiments of the present inventive concept relate to a display device.

2. Description of the Related Art

Reduction of power consumption may be desirable in a display device employed in a portable device, such as a smartphone, a tablet computer, etc., for example, in order to extend battery life. In order to reduce the power consumption of display devices, an adaptive refresh technique or an adaptive refresh panel (ARP) technique which refreshes a display panel at a frequency lower than an input frequency of input image data may be utilized.

However, in a display device using the ARP technique, a flicker may be caused by the low frequency driving. In particular, in a mode where the input frequency of the input image data is dynamically changed, the flicker may be intensified due to an excessive decrease of a driving frequency.

The above information disclosed in this Background section is only for enhancement of understanding of the background and therefore the information discussed in this Background section does not necessarily constitute prior art.

SUMMARY

Aspects of some example embodiments of the present inventive concept relate to a display device, and for example, to a display device that may be capable of performing adaptive refresh.

Aspects of some example embodiments include a display device that may be capable of preventing or reducing instances of a flicker occurring while performing adaptive refresh.

According to some example embodiments, a display device includes: a display panel including a plurality of pixels, a data driver configured to generate data voltages based on output image data, and to provide the data voltages to the plurality of pixels, and a controller configured to receive input image data and input frequency information from a host processor, and to provide the output image data to the data driver. The controller includes an adaptive refresh block configured to determine a target frequency by analyzing the input image data, to determine a masking ratio based on an input frequency represented by the input frequency information and the target frequency, and to selectively output the input image data as the output image data by performing a masking operation on the input image data with the masking ratio.

According to some example embodiments, the adaptive refresh block may calculate the masking ratio by dividing the target frequency by the input frequency.

According to some example embodiments, among the input image data of N frames, the adaptive refresh block may output the input image data of N*MR frames as the output image data, and may not output the input image data of remaining N*(1−MR) frames, where N is an integer greater than 0, and MR is the masking ratio greater than 0 and less than or equal to 1.

According to some example embodiments, during a period of the remaining N*(1−MR) frames where the input image data are not output, the adaptive refresh block may generate a disable signal. The data driver may be disabled in response to the disable signal.

According to some example embodiments, the controller may further include a data processing block that performs data processing on the output image data output from the adaptive refresh block. The data processing block may be disabled in response to the disable signal.

According to some example embodiments, when the input frequency of the input image data is changed, or when an image represented by the input image data is changed, the adaptive refresh block may not perform the masking operation on the input image data, and may output the input image data as the output image data.

According to some example embodiments, the adaptive refresh block may calculate a final masking ratio by dividing the target frequency by the input frequency, and may gradually decrease the masking ratio from 1 to the final masking ratio such that a frequency of the output image data is gradually decreased from the input frequency to the target frequency.

According to some example embodiments, the adaptive refresh block may include a frequency decision block configured to determine the target frequency based on a luminance distribution of the input image data, and a frequency mixing block configured to determine the masking ratio based on the input frequency represented by the input frequency information and the target frequency, and to selectively output the input image data as the output image data by performing the masking operation on the input image data with the masking ratio.

According to some example embodiments, the adaptive refresh block may further include an image analysis block configured to determine whether the input frequency of the input image data is changed, and whether an image represented by the input image data is changed.

According to some example embodiments, when the image analysis block determines that the input frequency of the input image data is changed or that the image represented by the input image data is changed, the frequency mixing block may not perform the masking operation on the input image data, and may output the input image data as the output image data.

According to some example embodiments, the frequency mixing block may calculate a final masking ratio by dividing the target frequency by the input frequency, and may gradually decrease the masking ratio from 1 to the final masking ratio such that a frequency of the output image data is gradually decreased from the input frequency to the target frequency.

According to some example embodiments, the controller may further include a frame memory configured to store the input image data received from the host processor in a command mode. The adaptive refresh block may receive the input image data from the frame memory in the command mode.

According to some example embodiments, a display device includes: a display panel including a plurality of pixels, a data driver configured to generate data voltages based on output image data, and to provide the data voltages to the plurality of pixels, and a controller configured to receive input image data and driving mode information from a host processor, and to provide the output image data to the data driver. The controller includes an adaptive refresh block configured to selectively output the input image data as the output image data by performing a masking operation on the input image data when the driving mode information represents a still image mode, and to output the input image data as the output image data without performing the masking operation on the input image data when the driving mode information represents a moving image mode.

According to some example embodiments, in the still image mode, the adaptive refresh block may determine a target frequency by analyzing the input image data, may determine a masking ratio based on the target frequency, and may selectively output the input image data as the output image data by performing the masking operation on the input image data with the masking ratio.

According to some example embodiments, in the still image mode, among the input image data of N frames, the adaptive refresh block may output the input image data of N*MR frames as the output image data, and may not output the input image data of remaining N*(1−MR) frames, where N is an integer greater than 0, and MR is the masking ratio greater than 0 and less than or equal to 1.

According to some example embodiments, in the still image mode, the adaptive refresh block may determine a final masking ratio based on the target frequency, and may gradually decrease the masking ratio from 1 to the final masking ratio such that a frequency of the output image data is gradually decreased to the target frequency.

According to some example embodiments, the adaptive refresh block may include an image analysis block configured to determine whether an image represented by the input image data is changed, a frequency decision block configured to determine a target frequency based on a luminance distribution of the input image data, a frequency mixing block configured to determine a masking ratio based on the target frequency, and to selectively output the input image data as the output image data by performing the masking operation on the input image data with the masking ratio, and a switch configured to allow the input image data to bypass the image analysis block, the frequency decision block and the frequency mixing block such that the input image data are output as the output image data when the driving mode information represents the moving image mode.

According to some example embodiments, when the image analysis block determines that the image is changed, the frequency mixing block may not perform the masking operation on the input image data, and may output the input image data as the output image data.

According to some example embodiments, the frequency mixing block may determine a final masking ratio based on the target frequency, and may gradually decrease the masking ratio from 1 to the final masking ratio such that a frequency of the output image data is gradually decreased to the target frequency.

According to some example embodiments, the controller may further include a frame memory configured to store the input image data received from the host processor. The still image mode may be a command mode in which the adaptive refresh block receives the input image data stored in the frame memory, and the moving image mode may be a video mode in which the input image data are not stored in the frame memory and the adaptive refresh block receives the input image data from the host processor.

As described above, a display device according to some example embodiments may receive input frequency information representing an input frequency of input image data, may determine a masking ratio based on the input frequency represented by the input frequency information and a target frequency, and may perform a masking operation on the input image data with the masking ratio. Accordingly, even if the input frequency of the input image data is changed, the display device may perform the masking operation with the optimal masking ratio, and thus may perform adaptive refresh without an occurrence of a flicker.

Further, the display device according to some example embodiments may receive driving mode information, may perform the masking operation when the driving mode information represents a still image mode (e.g., a command mode), and may not perform the masking operation when the driving mode information represents a moving image mode (e.g., a video mode). Accordingly, the power consumption of the display device may be reduced in the still image mode, and the occurrence of the flicker in the moving image mode may be prevented or reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, aspects of some example embodiments of the present inventive concept will be explained in more detail with reference to the accompanying drawings.

Figure 1:
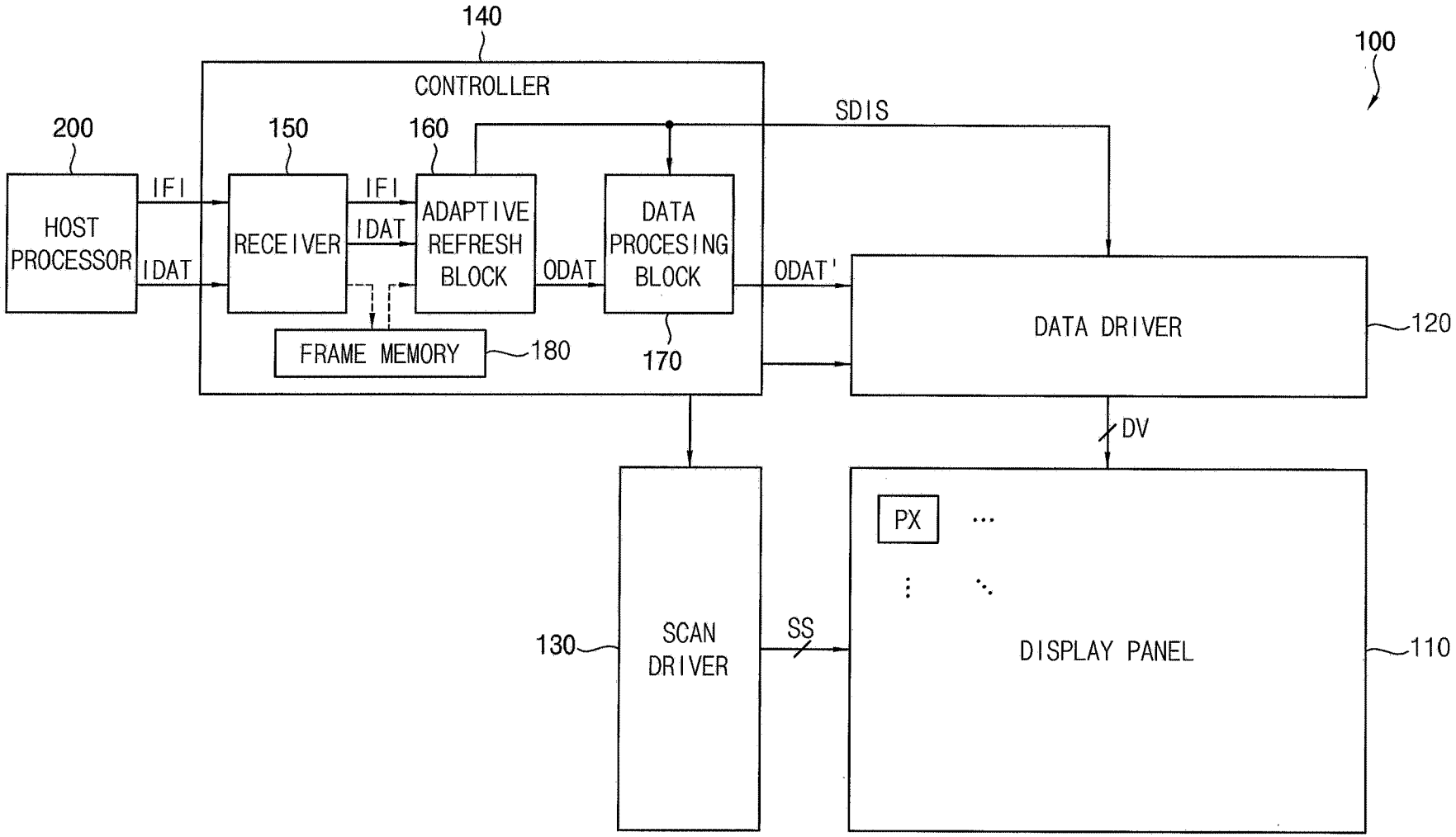
FIG. 1 is a block diagram illustrating a display device according to some example embodiments.
Figure 2:
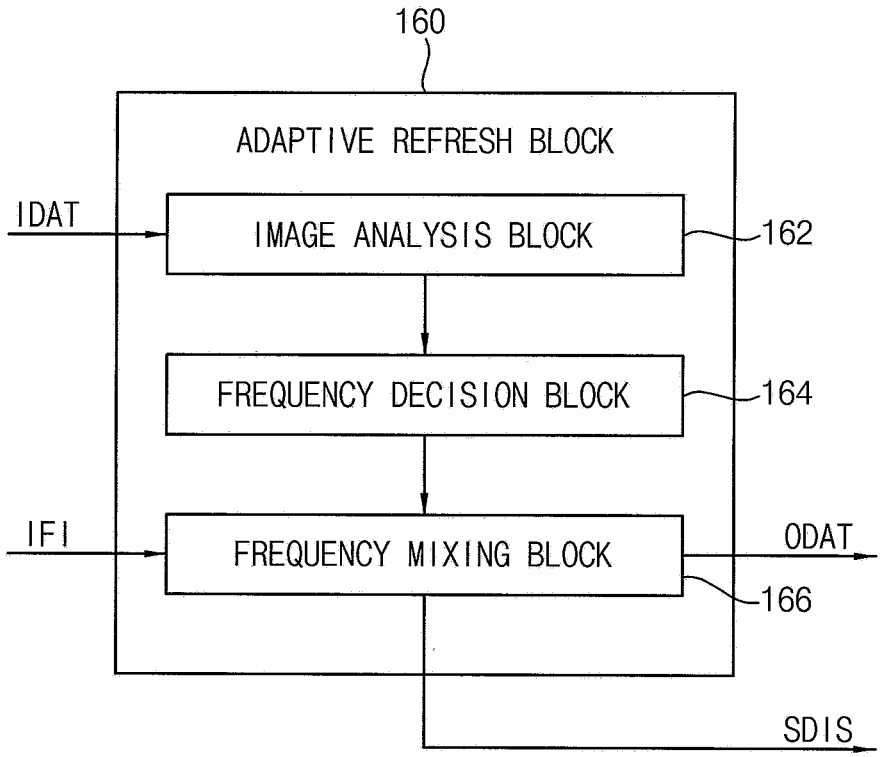
FIG. 2 is a block diagram illustrating an adaptive refresh block included in a display device of FIG. 1.

FIG. 1 is a block diagram illustrating a display device according to some example embodiments, and FIG. 2 is a block diagram illustrating an adaptive refresh block included in a display device of FIG. 1.

Referring to FIG. 1, a display device 100 according to some example embodiments may include a display panel 110 that includes a plurality of pixels PX, a data driver 120 that provides data voltages DV to the plurality of pixels PX, a scan driver 130 that provides scan signals SS to the plurality of pixels PX, and a controller 140 that controls the data driver 120 and the scan driver 130.

The display panel 110 may include a plurality of data lines, a plurality of scan lines, and the plurality of pixels PX coupled to the plurality of data lines and the plurality of scan lines. Although a single pixel PX is illustrated and labeled in FIG. 1 for convenience of illustration, a person having ordinary skill in the art would understand that embodiments according to the present disclosure may include any suitable number of pixels PX according to the design of the display panel 110.

In some example embodiments, each pixel PX may include at least one capacitor, at least two transistors and an organic light emitting diode (OLED), and the display panel 110 may be an OLED display panel. Further, in some example embodiments, each pixel PX may be a hybrid pixel suitable for low frequency driving for reducing power consumption. For example, in the hybrid pixel, a driving transistor may be implemented with a low-temperature polycrystalline silicon (LTPS) PMOS transistor, and a switching transistor may be implemented with an oxide NMOS transistor. In other example embodiments, the display panel 110 may be a liquid crystal display (LCD) panel, or the like.

The data driver 120 may generate the data voltages DV based on output image data ODAT' and a data control signal output from the controller 140, and may provide the data voltages DV to the plurality of pixels PX through the plurality of data lines. In some example embodiments, the data control signal may include (but may not be limited to) an output data enable signal, a horizontal start signal and a load signal. Further, in some example embodiments, the data driver 120 may receive a disable signal SDIS from the controller 140 (or an adaptive refresh block 160 or an adaptive refresh circuit 160). The data driver 120 may be disabled while the disable signal SDIS has a level representing that the data driver 120 is to be disabled. Thus, the data driver 120 may be disabled in response to the disable signal SDIS, thereby reducing the power consumption. In some example embodiments, the data driver 120 and the controller 140 may be implemented with a single integrated circuit, and the integrated circuit may be referred to as a timing controller embedded data driver (TED). According to some example embodiments, the data driver 120 and the controller 140 may be implemented with separate integrated circuits.

The scan driver 130 may provide the scan signals SS to the plurality of pixels PX through the plurality of scan lines based on a scan control signal received from the controller 140. In some example embodiments, the scan driver 130 may sequentially provide the scan signals SS to the plurality of pixels PX on a row-by-row basis. Further, in some example embodiments, the scan control signal may include, but not be limited to, a scan start signal and a scan clock signal. In some example embodiments, the scan driver 130 may be integrated or formed in a peripheral portion of the display panel 110. In other example embodiments, the scan driver 130 may be implemented in the form of an integrated circuit.

The controller (e.g., a timing controller; TCON) 140 may receive input image data IDAT and a control signal from an external host processor (e.g., an application processor (AP), a graphic processing unit (GPU) or a graphic card) 200. In some example embodiments, the input image data IDAT may be an RGB image data including red image data, green image data and blue image data. Further, in some example embodiments, the control signal may include, but not be limited to, a vertical synchronization signal, a horizontal synchronization signal, an input data enable signal, a master clock signal, etc. The controller 140 may generate the data control signal, the scan control signal and the output image data ODAT' based on the input image data IDAT and the control signal. The controller 140 may control an operation of the data driver 120 by providing the output image data ODAT' and the data control signal to the data driver 120, and may control an operation of the scan driver 130 by providing the scan control signal to the scan driver 130.

The controller 140 may further receive input frequency information IFI representing an input frequency of the input image data IDAT from the host processor 200. In some example embodiments, each time the controller 140 receives the input image data IDAT of one frame, the controller 140 may receive the input frequency information IFI from the host processor 200. In other example embodiments, the controller 140 may receive the input frequency information IFI from the host processor 200 when the input frequency of the input image data IDAT is changed. In still other example embodiments, the controller 140 may receive the input frequency information IFI from the host processor 200 in a moving image mode (e.g., a video mode of a mobile industry processor interface (MIPI)). In this case, in a still image mode (e.g., a command mode of the MIPI), the controller 140 may not receive the input frequency information IFI from the host processor 200, or may receive the input frequency information IFI from the host processor 200 when the input image data IDAT stored in a frame memory 180 are changed.

In some example embodiments, as illustrated in FIG. 1, the controller 140 may include a receiver 150, an adaptive refresh block 160, a data processing block 170 and the frame memory 180.

The receiver 150 may provide a suitable interface (e.g., the MIPI) between the host processor 200 and the controller 140, and may be configured to receive the input image data IDAT and the input frequency information IFI from the host processor 200. In some example embodiments, the input image data IDAT received by the receiver 150 may be provided to the adaptive refresh block 160 in the moving image mode (e.g., the video mode of the MIPI), and may be provided to the frame memory 180 in the still image mode (e.g., the command mode of the MIPI).

The data processing block (or data processing circuit) 170 may perform data processing on the output image data ODAT output from the adaptive refresh block 160, and may provide the output image data ODAT' on which the data processing is performed to the data driver 120. In some example embodiments, the data processing performed by the data processing block 170 may include, but not be limited to, a pentile data conversion that converts the RGB image data into image data suitable for a pentile pixel structure, a luminance compensation, a color correction, etc. Further, in some example embodiments, the data processing block 170 may receive the disable signal SDIS from the adaptive refresh block 160, and may be disabled while the disable signal SDIS has the level representing that the data processing block 170 is to be disabled. Thus, the data processing block 170 may be disabled in response to the disable signal SDIS, thereby reducing the power consumption.

The frame memory 180 may store the input image data IDAT received from the host processor 200 in the still image mode (e.g., the command mode of the MIPI). In the moving image mode (e.g., the video mode of the MIPI), the input image data IDAT may not be stored in the frame memory 180. In some example embodiments, in the command mode, the host processor 200 may provide the input image data IDAT to the display device 100 only when a still image represented by the input image data IDAT is changed, the receiver 150 may provide the input image data IDAT provided from the host processor 200 not to the adaptive refresh block 160 but to the frame memory 180, and the frame memory 180 may store the input image data IDAT received by the receiver 150. Further, in the command mode, the adaptive refresh block 160 may receive the input image data IDAT periodically or at a fixed input frequency (e.g., about 60 Hz) from the frame memory 180.

The adaptive refresh block 160 may receive the input image data IDAT and the input frequency information IFI. In some example embodiments, the adaptive refresh block 160 may receive the input image data IDAT and the input frequency information IFI through the receiver 150 from the host processor 200 in the moving image mode (e.g., the video mode of the MIPI). In some example embodiments, in the still image mode (e.g., the command mode of the MIPI), the adaptive refresh block 160 may receive the input image data IDAT from the frame memory 180, and may receive the input frequency information IFI representing the fixed input frequency (e.g., about 60 Hz) provided from the host processor 200 or generated by the controller 140.

The adaptive refresh block 160 may determine a target frequency by analyzing the input image data IDAT, may determine a masking ratio based on the input frequency represented by the input frequency information IFI and the target frequency, and may selectively output the input image data IDAT as the output image data ODAT by performing a masking operation on the input image data IDAT with the masking ratio.

Here, the masking operation may include a data processing operation that does not output the input image data IDAT and/or that changes the input image data IDAT to a fixed value (e.g., 0). In some example embodiments, in a frame where the input image data IDAT are masked, a data enable signal (e.g., the output data enable signal) may be fixed to a low level, and the vertical and horizontal synchronization signals may be deactivated. Further, in some example embodiments, in the frame where the input image data IDAT are masked, the adaptive refresh block 160 may generate the disable signal SDIS, and the data processing block 170 and/or the data driver 120 may be disabled in response to the disable signal SDIS. Accordingly, the power consumption of the display device 100 may be reduced. Thus, according to some example embodiments, by performing a masking operation, a disable signal may cause a data processor or data driver to be disabled thereby reducing the amount of power consumed by the display device 100.

In some example embodiments, the adaptive refresh block 160 may calculate the masking ratio by dividing the target frequency by the input frequency, and may perform the masking operation on the input image data IDAT with the calculated masking ratio. In some example embodiments, the target frequency may be lower than the input frequency, and the masking ratio may be greater than 0 and less than or equal to 1. Here, performing the masking operation on the input image data IDAT with the masking ratio of 1/N may mean that, among the input image data IDAT of N frames, the input image data IDAT of one frame may be output, and the input image data IDAT of the remaining (N−1) frames are masked and not output, where N is an integer greater than 0. For example, among the input image data IDAT of N frames, the adaptive refresh block 160 may output the input image data IDAT of N*MR frames as the output image data ODAT, and may not output the input image data IDAT of remaining N*(1−MR) frames, where MR is the masking ratio greater than 0 and less than or equal to 1. Further, during a period of the remaining N*(1−MR) frames where the input image data IDAT are not output, the adaptive refresh block 160 may generate the disable signal SDIS, and the data processing block 170 and/or the data driver 120 may be disabled in response to the disable signal SDIS.

A related-art display device may not receive the input frequency information IFI from the host processor 200. Thus, the related-art display device may perform the masking operation based on a fixed input frequency (e.g., about 60 Hz). Accordingly, the input image data IDAT may be excessively masked, a frequency of the output image data ODAT, or a refresh frequency of the display panel 110 may become lower than the target frequency, and a flicker may occur in an image displayed by the related-art display device.

However, in the display device 100 according to some example embodiments, the adaptive refresh block 160 may receive the input frequency information IFI, may determine the masking ratio based on the input frequency information IFI, and may perform the masking operation on the input image data IDAT with the masking ratio. Accordingly, in the display device 100 according to some example embodiments, the frequency of the output image data ODAT, or the refresh frequency of the display panel 110 may become substantially the same as the target frequency, and instances of the flicker occurring in an image displayed at the display panel 110 may be prevented or reduced.

In some example embodiments, the adaptive refresh block 160 may determine whether the input image data IDAT has a fixed frequency (or perform a fixed frequency detection (FFD)), and/or whether the input image data IDAT represent a still image (or perform a still image detection (SID)). That is, the adaptive refresh block 160 may determine whether the input frequency of the input image data IDAT is changed, and whether an image represented by the input image data IDAT is changed. When the input frequency of the input image data IDAT is changed, or when the image represented by the input image data IDAT is changed, the adaptive refresh block 160 may not perform the masking operation on the input image data IDAT, and may output the input image data IDAT as the output image data ODAT.

In some example embodiments, the adaptive refresh block 160 may gradually decrease the frequency of the output image data ODAT, or the refresh frequency of the display panel 110 from the input frequency to the target frequency. For example, the adaptive refresh block 160 may calculate a final masking ratio by dividing the target frequency by the input frequency, and may gradually decrease the masking ratio from 1 to the final masking ratio such that the frequency of the output image data ODAT is gradually decreased from the input frequency to the target frequency.

In some example embodiments, as illustrated in FIG. 2, the adaptive refresh block 160 may include an image analysis block (or image analysis circuit) 162, a frequency decision block (or frequency decision circuit) 164 and a frequency mixing block (or frequency mixing circuit) 166.

The image analysis block 162 may perform the fixed frequency detection (FFD) and/or the still image detection (SID). That is, the image analysis block 162 may determine whether the input frequency of the input image data IDAT is changed, and whether the image represented by the input image data IDAT is changed. For example, the image analysis block 162 may determine whether or not the input frequency of the input image data IDAT is changed by analyzing the number of the data enable signals between two vertical synchronization signals and a length of a blank period, and may determine whether the image represented by the input image data IDAT is changed by comparing a representative value (e.g., an average value, a checksum, etc.) of previous frame data and a representative value of current frame data.

When the image analysis block 162 determines that the input frequency of the input image data IDAT is changed or that the image represented by the input image data IDAT is changed, the input image data IDAT may be output as the output image data ODAT without performing subsequent operations. For example, the frequency decision block 164 may not decide the target frequency, and the frequency mixing block 166 may not perform the masking operation on the input image data IDAT, and may output the input image data IDAT as the output image data ODAT.

The frequency decision block 164 may determine the target frequency based on a luminance distribution of the input image data IDAT. In some example embodiments, the frequency decision block 164 (or the frequency mixing block 166) may determine, as the target frequency, a lowest frequency at which the flicker is not perceived in an image corresponding to the input image data IDAT. For example, the frequency decision block 164 may obtain a flicker value (or the flicker value representing a level of the flicker perceived by a user) of the image corresponding to the input image data IDAT according to the luminance distribution of the input image data IDAT, and may determine, as the target frequency, the lowest frequency at which the flicker is not perceived according to the flicker value. In some example embodiments, the frequency decision block 164 may include a lookup table that stores flicker values corresponding to respective gray levels, and may obtain the flicker value of the input image data IDAT using the lookup table. However, obtaining the flicker value may not be limited to using the lookup table.

The frequency mixing block 166 may receive the input frequency information IFI representing the input frequency of the input image data IDAT, and may receive the target frequency from the frequency decision block 164. The frequency mixing block 166 may determine the masking ratio based on the input frequency represented by the input frequency information IFI and the target frequency, and may selectively output the input image data IDAT as the output image data ODAT by performing the masking operation on the input image data IDAT with the masking ratio. Accordingly, the frequency mixing block 166 may output the output image data ODAT at the target frequency lower than the input frequency of the input image data IDAT, the data driver 120 may receive the output image data ODAT' at the target frequency, and the display panel 110 may display (or refresh) an image at the target frequency, thereby reducing the power consumption of the display device 100.

Because the frequency mixing block 166 receives the input frequency information IFI, the frequency mixing block 166 may perform the masking operation with an optimal masking ratio even if the input frequency of the input image data IDAT is changed, and thus the display device 100 according to some example embodiments may perform the adaptive refresh without the occurrence of the flicker. Thus, according to some example embodiments, the frequency mixing block of the display device 100 may be configured to adjust the masking ratio of the masking operation according to the input frequency of the input image data IDAT in order to prevent or reduce the occurrence or appearance of flicker.

In some example embodiments, the frequency mixing block 166 may gradually decrease the frequency of the output image data ODAT, or the refresh frequency of the display panel 110 from the input frequency to the target frequency. For example, the frequency mixing block 166 may calculate a final masking ratio by dividing the target frequency by the input frequency, and may gradually decrease the masking ratio from 1 to the final masking ratio such that the frequency of the output image data ODAT is gradually decreased from the input frequency to the target frequency.

As described above, the display device 100 according to some example embodiments may receive the input frequency information IFI representing the input frequency of the input image data IDAT, may determine the masking ratio based on the input frequency represented by the input frequency information IFI and the target frequency, and may perform the masking operation on the input image data IDAT with the masking ratio. Accordingly, even if the input frequency of the input image data IDAT is changed, the display device 100 may perform the masking operation with the optimal masking ratio, and thus may perform the adaptive refresh without the occurrence of the flicker.

Figure 3:
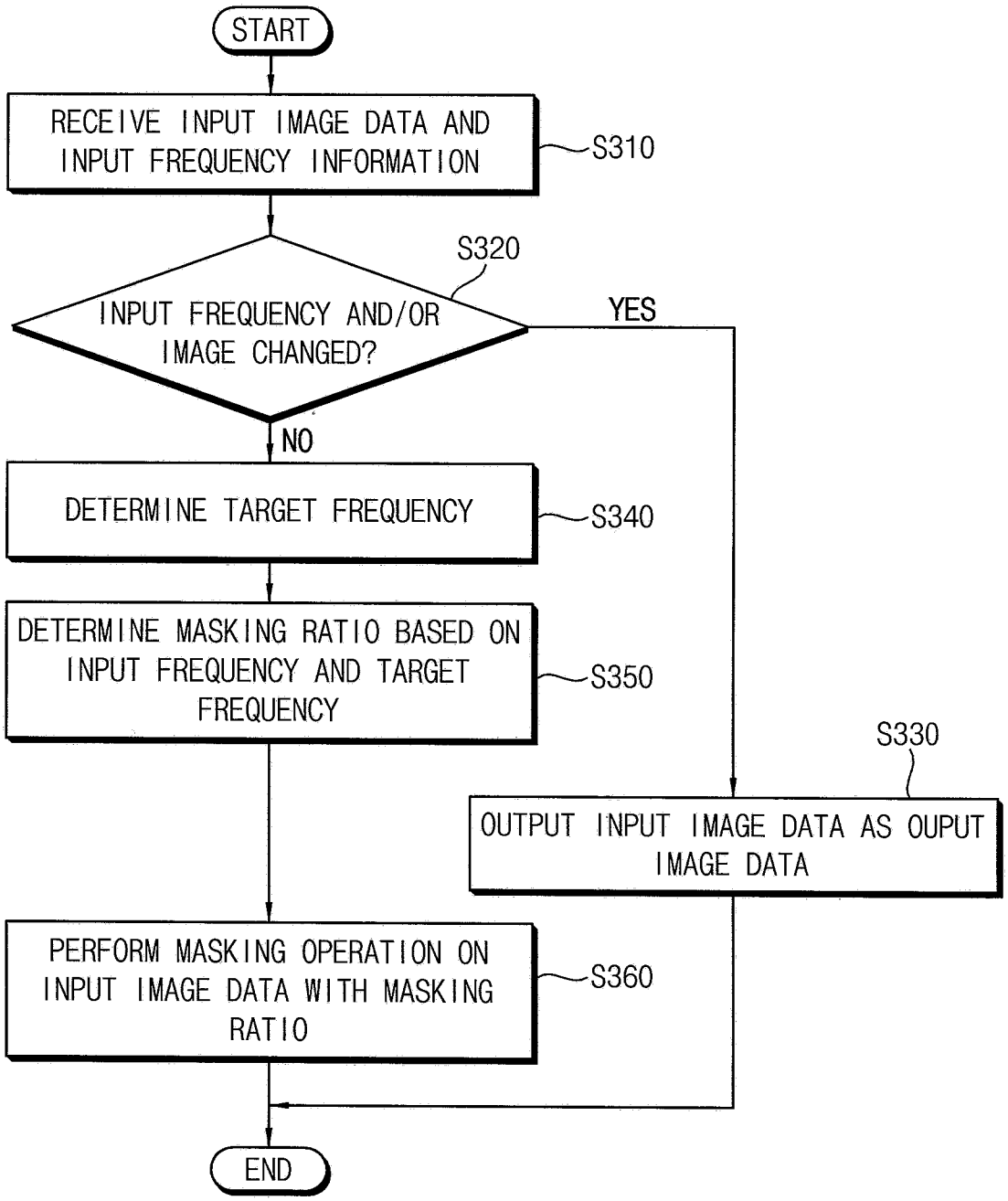
FIG. 3 is a flowchart illustrating a method of operating a display device according to some example embodiments.
Figure 4:
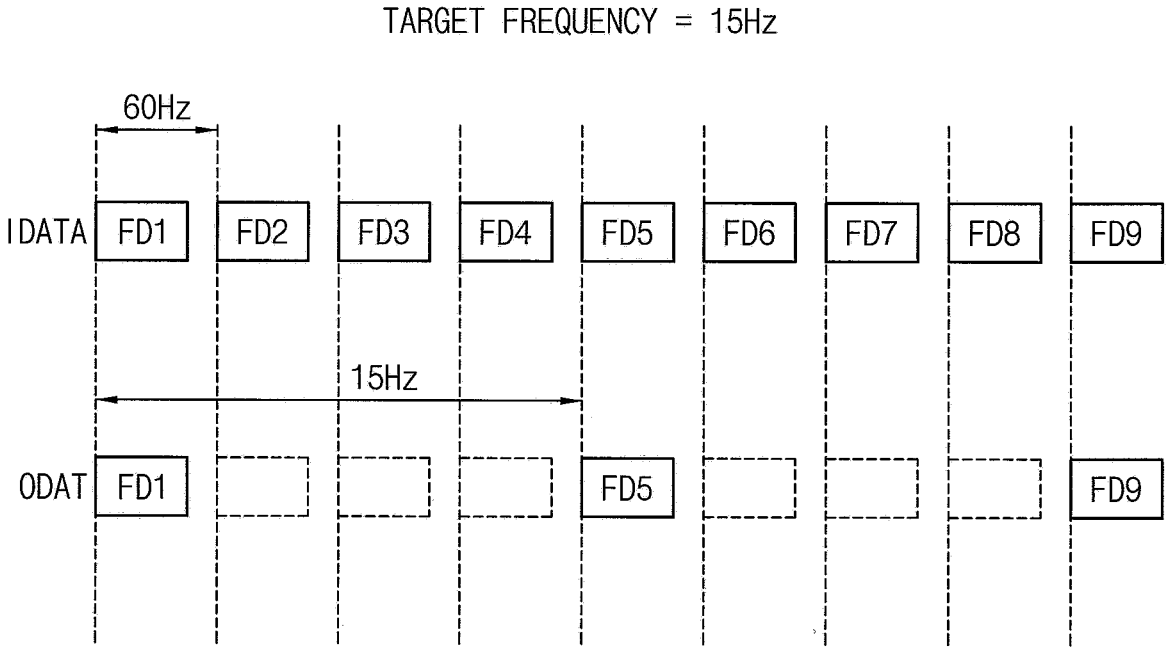
FIG. 4 is a diagram for describing an example of an operation of an adaptive refresh block.
Figure 5A:
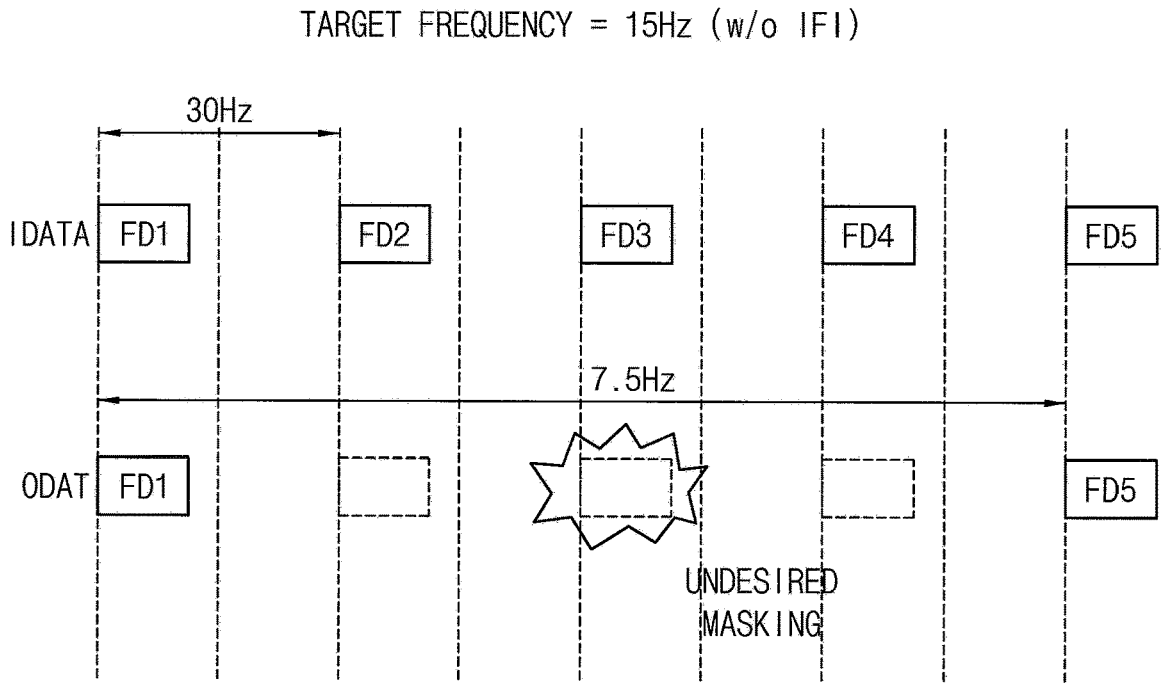
FIG. 5A is a diagram for describing an example of an operation of an adaptive refresh block that does not receive input frequency information.
Figure 5B:
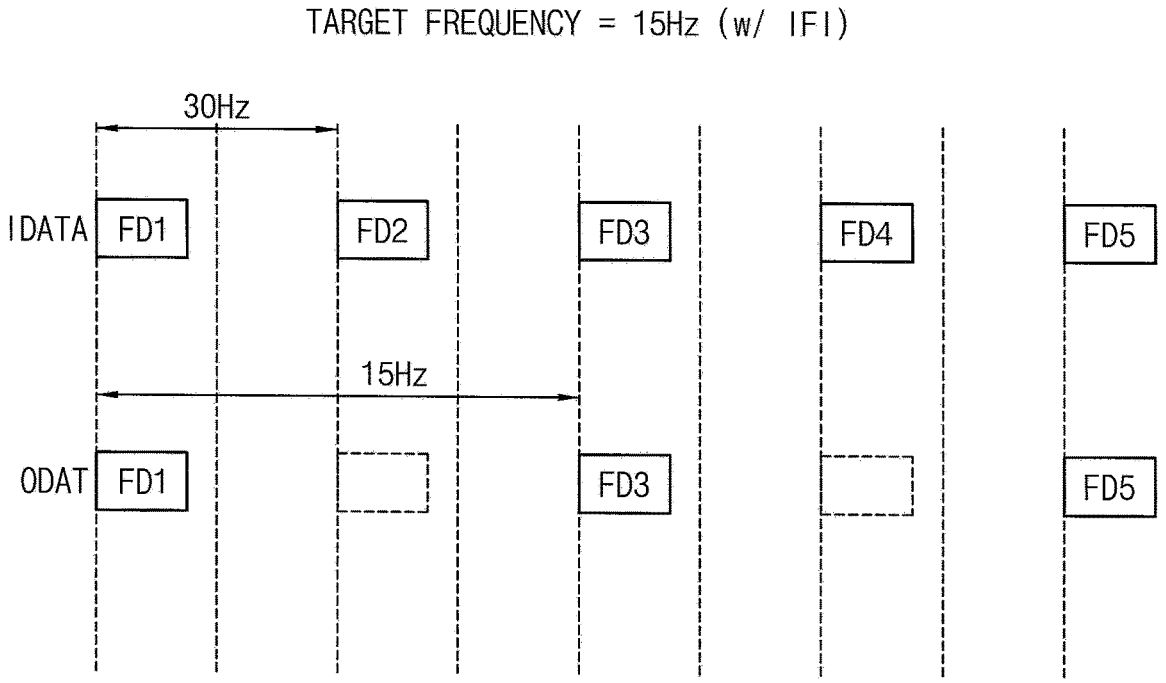
FIG. 5B is a diagram for describing an example of an operation of an adaptive refresh block that receives input frequency information.

FIG. 3 is a flowchart illustrating a method of operating a display device according to some example embodiments, FIG. 4 is a diagram for describing an example of an operation of an adaptive refresh block, FIG. 5A is a diagram for describing an example of an operation of an adaptive refresh block that does not receive input frequency information, and FIG. 5B is a diagram for describing an example of an operation of an adaptive refresh block that receives input frequency information.

Referring to FIGS. 1 through 3, a controller 140 may receive input image data IDAT, and input frequency information IFI representing an input frequency of the input image data IDAT (S310). An image analysis block 162 of an adaptive refresh block 160 may determine whether the input frequency of the input image data IDAT is changed, and whether an image represented by the input image data IDAT is changed (S320). When the input frequency of the input image data IDAT is changed or when the image represented by the input image data IDAT is changed (S320: YES), the adaptive refresh block 160 may not perform a masking operation on the input image data IDAT, and may output the input image data IDAT as output image data ODAT (S330).

When the input frequency of the input image data IDAT is not changed and when the image represented by the input image data IDAT is not changed (S320: NO), a frequency decision block 164 of the adaptive refresh block 160 may determine a target frequency based on a luminance distribution of the input image data IDAT (S340). A frequency mixing block 166 of the adaptive refresh block 160 may determine a masking ratio based on the input frequency represented by the input frequency information IFI and the target frequency (S350). For example, the frequency mixing block 166 may calculate the masking ratio by dividing the target frequency by the input frequency. Further, the frequency mixing block 166 may selectively output the input image data IDAT as the output image data ODAT by performing the masking operation on the input image data IDAT with the masking ratio (S360).

A data processing block 170 may perform data processing on the output image data ODAT output from the frequency mixing block 166, and may provide the output image data ODAT' on which the data processing is performed to a data driver 120. The data driver 120 may provide a display panel 110 with data voltages DV corresponding to the output image data ODAT', and the display panel 110 may display an image corresponding to the output image data ODAT' based on the data voltages DV.

For example, as illustrated in FIG. 4, in a case where the input frequency of the input image data IDAT is about 60 Hz, and the target frequency determined by analyzing the input image data IDAT is about 15 Hz, the frequency mixing block 166 may calculate the masking ratio of 1/4 by dividing the target frequency of about 15 Hz by the input frequency of about 60 Hz, and may perform the masking operation on the input image data IDAT with the masking ratio of 1/4. That is, with respect to first through fourth frame data FD1, FD2, FD3 and FD4, the frequency mixing block 166 may output the first frame data FD1 as the output image data ODAT, and may not output the second through fourth frame data FD2, FD3 and FD4. Further, the frequency mixing block 166 may output fifth and ninth frame data FD5 and FD9, and may not output sixth through eighth frame data FD6, FD7 and FD8. Accordingly, the display panel 110 may display (or refresh) an image at the target frequency of about 15 Hz lower than the input frequency of about 60 Hz, and thus power consumption of a display device 100 may be reduced.

In a display device that does not receive the input frequency information IFI, even if the input frequency of the input image data IDAT is changed from about 60 Hz in FIG. 4 to about 30 Hz in FIG. 5A, the display device may not know the change of the input frequency. In this case, the display device may assume that the input frequency is fixed or about 60 Hz, and may determine the masking ratio as 1/4 by considering only the target frequency. Thus, the display device may mask three frame data FD2, FD3 and FD4 among four frame data FD1, FD2, FD3 and FD4, and may display an image based on one frame data FD1. In this case, at least one frame data FD3 may be undesirably masked. Accordingly, in the display device, an image is displayed (or refreshed) at a frequency of about 7.5 Hz lower than the target frequency of about 15 Hz, and thus a flicker may be perceived.

However, the display device 100 according to some example embodiments may receive the input frequency information IFI, and thus may be informed of the change of the input frequency when the input frequency of the input image data IDAT is changed from about 60 Hz in FIG. 4 to about 30 Hz in FIG. 5B. The display device 100 may determine the masking ratio as 1/2 based on the input frequency of about 30 Hz represented by the input frequency information IFI and the target frequency of about 15 Hz. Thus, the display device 100 may mask one frame data (e.g., FD2) among two frame data (e.g., FD1 and FD2), and may display an image based on another frame data (e.g., FD1). That is, even if the input frequency of the input image data IDAT is changed, the display device 100 may perform the masking operation with the optimal masking Ratio (e.g., 1/2), and thus may display (or refresh) the image at the target frequency of about 15 Hz. Accordingly, flicker occurring in the display device 100 may be prevented or reduced according to some example embodiments.

Figure 6:
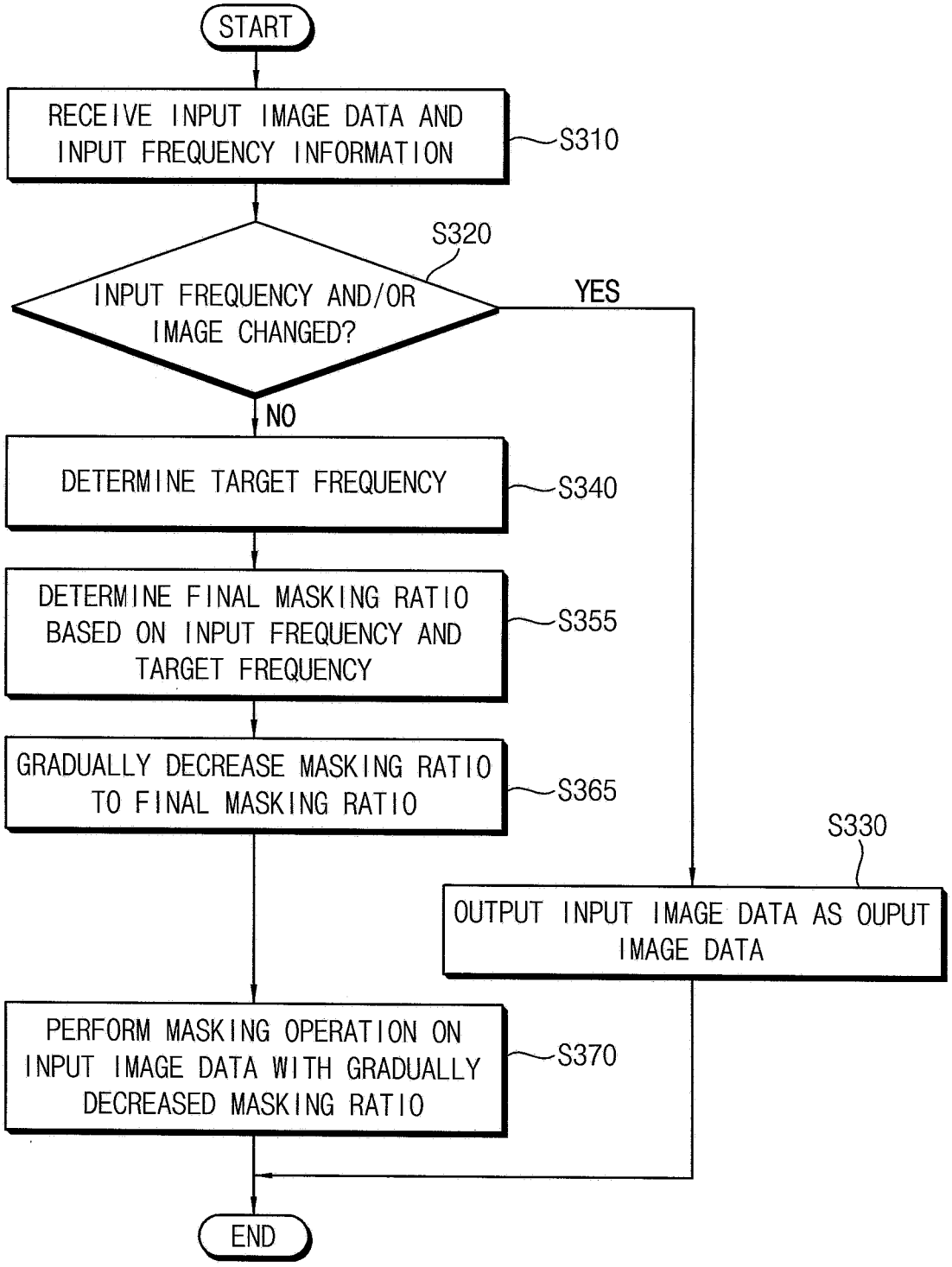
FIG. 6 is a flowchart illustrating a method of operating a display device according to some example embodiments.
Figure 7:
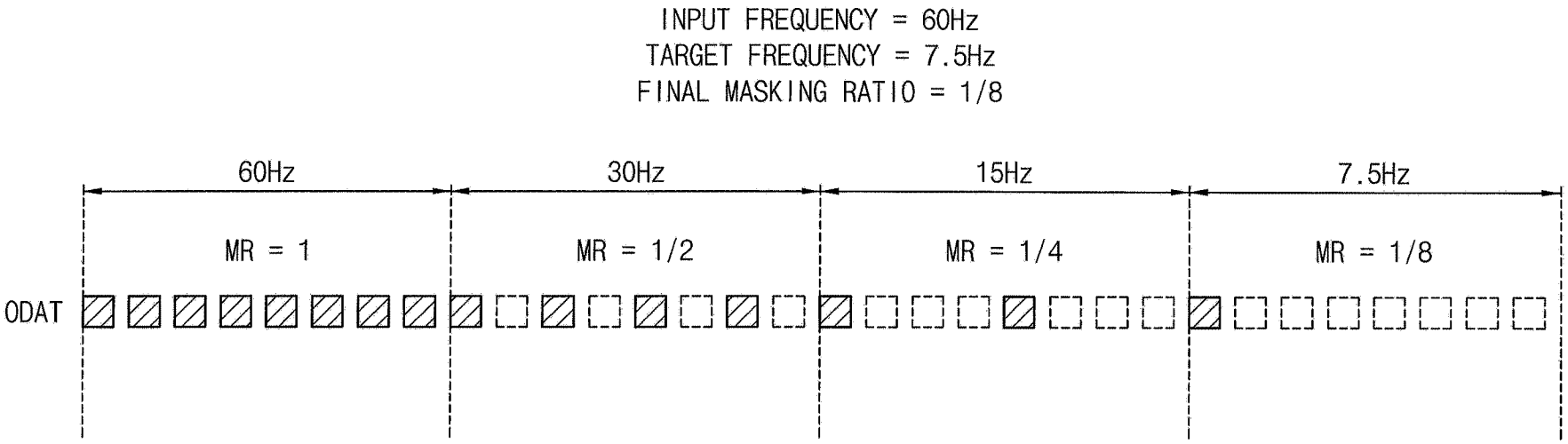
FIG. 7 is a diagram for describing an example of a frequency of output image data that are output from an adaptive refresh block.

FIG. 6 is a flowchart illustrating a method of operating a display device according to some example embodiments, and FIG. 7 is a diagram for describing an example of a frequency of output image data that are output from an adaptive refresh block.

Referring to FIGS. 1, 2 and 6, a controller 140 may receive input image data IDAT, and input frequency information IFI representing an input frequency of the input image data IDAT (S310). An image analysis block 162 of an adaptive refresh block 160 may determine whether the input frequency of the input image data IDAT is changed, and whether an image represented by the input image data IDAT is changed (S320). When the input frequency of the input image data IDAT is changed or when the image represented by the input image data IDAT is changed (S320: YES), the adaptive refresh block 160 may not perform a masking operation on the input image data IDAT, and may output the input image data IDAT as output image data ODAT (S330).

When the input frequency of the input image data IDAT is not changed and when the image represented by the input image data IDAT is not changed (S320: NO), a frequency decision block 164 of the adaptive refresh block 160 may determine a target frequency based on a luminance distribution of the input image data IDAT (S340). A frequency mixing block 166 of the adaptive refresh block 160 may calculate a final masking ratio by dividing the target frequency by the input frequency (S355). The frequency mixing block 166 may gradually decrease a masking ration from 1 to the final masking ratio (S365). The frequency mixing block 166 may selectively output the input image data IDAT as output image data ODAT by performing the masking operation on the input image data IDAT with the gradually decreased masking ratio (S370). A data processing block 170 may perform data processing on the output image data ODAT output from the frequency mixing block 166, and may provide the output image data ODAT' on which the data processing is performed to a data driver 120. The data driver 120 may provide a display panel 110 with data voltages DV corresponding to the output image data ODAT', and the display panel 110 may display an image corresponding to the output image data ODAT' based on the data voltages DV.

Because the masking ration is gradually decreased from 1 to the final masking ratio, a frequency of the output image data ODAT, or a refresh frequency of the display panel 110 may be gradually decreased from the input frequency to the target frequency. For example, as illustrated in FIG. 7, in a case where the input frequency of the input image data IDAT is about 60 Hz, and the target frequency determined by analyzing the input image data IDAT is about 7.5 Hz, the frequency mixing block 166 may calculate the final masking ratio of 1/8 by dividing the target frequency of about 7.5 Hz by the input frequency of about 60 Hz. Further, the frequency mixing block 166 may gradually decrease the masking ratio MR from 1 to 1/2, to 1/4, and to 1/8. Thus, an image may be displayed by eight frame data among eight frame data when the masking ratio is 1, the image may be displayed by four frame data among eight frame data when the masking ratio is 1/2, the image may be displayed by two frame data among eight frame data when the masking ratio is 1/4, and the image may be displayed by one frame data among eight frame data when the masking ratio is 1/8. Accordingly, the refresh frequency of the display panel 110, or an image display frequency may be gradually decreased from about 60 Hz, to about 30 Hz, to about 15 Hz, and to about 7.5 Hz, and thus the occurrence of the flicker caused by a sudden change of the image display frequency may be further prevented or reduced.

Figure 8:
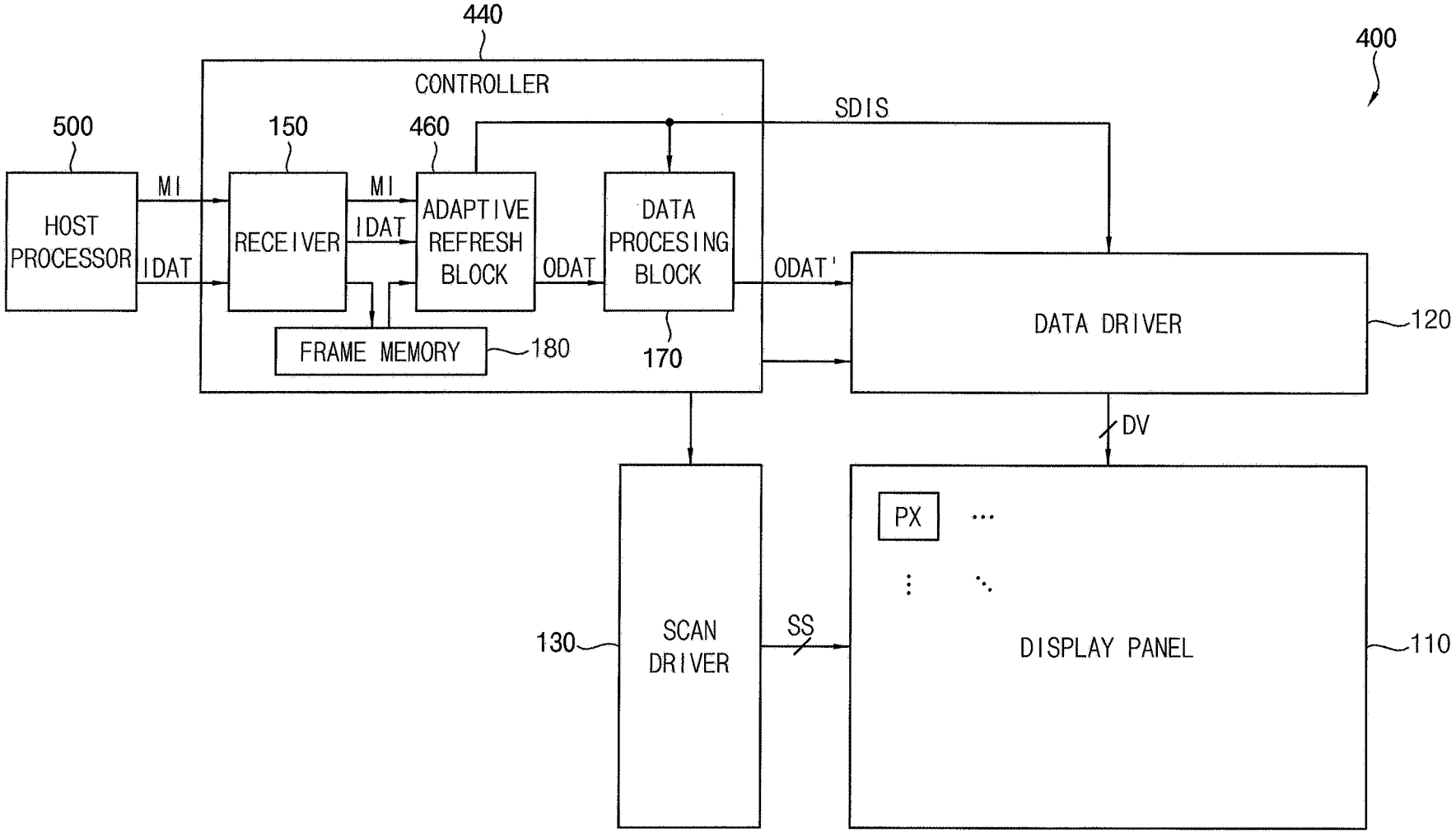
FIG. 8 is a block diagram illustrating a display device according to some example embodiments.
Figure 9:
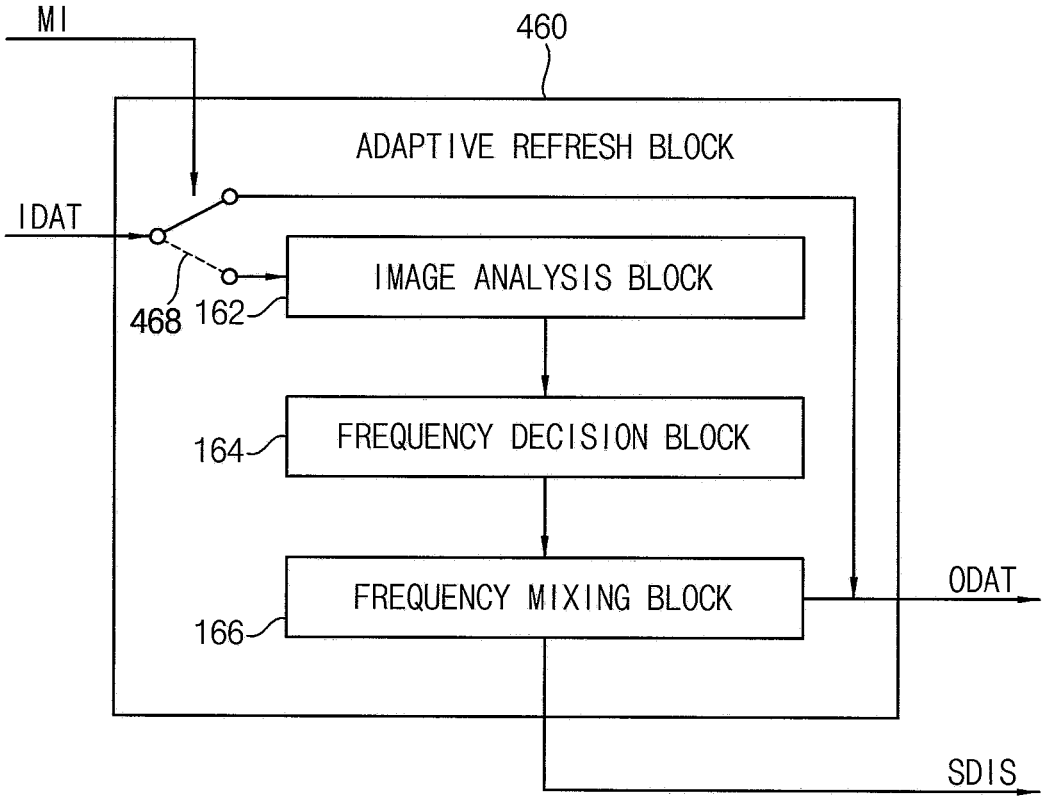
FIG. 9 is a block diagram illustrating an adaptive refresh block included in a display device of FIG. 8.

FIG. 8 is a block diagram illustrating a display device according to some example embodiments, and FIG. 9 is a block diagram illustrating an adaptive refresh block included in a display device of FIG. 8.

Referring to FIG. 8, a display device 400 according to some example embodiments may include a display panel 110, a data driver 120, a scan driver 130 and a controller 440. The display device 400 of FIG. 8 may have a similar configuration and a similar operation to a display device 100 of FIG. 1, except that an adaptive refresh block 460 of the controller 440 may receive driving mode information MI from a host processor 500, and may selectively perform adaptive refresh according to a driving mode represented by the driving mode information MI.

The driving mode information MI received from the host processor 500 may represent a still image mode in which an input frequency of input image data IDAT provided to the adaptive refresh block 460 is not changed, or a moving image mode in which the input frequency of the input image data IDAT is changed. In some example embodiments, the still image mode may be a command mode of a mobile industry processor interface (MIPI), and the moving image mode may be a video mode of the MIPI. In the still image mode, the input image data IDAT received from the host processor 500 may be stored in a frame memory 180, and the adaptive refresh block 460 may receive the input image data IDAT at a fixed input frequency (e.g., about 60 Hz) from the frame memory 180. In the moving image mode, the input image data IDAT received from the host processor 500 may not be stored in the frame memory 180, and the adaptive refresh block 460 may receive the input image data IDAT from the host processor 500 through a receiver 150.

The adaptive refresh block 460 may selectively output the input image data IDAT as the output image data ODAT by performing a masking operation on the input image data IDAT when the driving mode information MI represents the still image mode (e.g., the command mode), and may output the input image data IDAT as the output image data ODAT without performing the masking operation on the input image data IDAT when the driving mode information MI represents the moving image mode (e.g., the video mode). For example, in the still image mode, the adaptive refresh block 460 may determine a target frequency by analyzing the input image data IDAT, may determine a masking ratio based on the target frequency, and may selectively output the input image data IDAT as the output image data ODAT by performing the masking operation on the input image data IDAT with the masking ratio. According to some example embodiments, in the still image mode, among the input image data IDAT of N frames, the adaptive refresh block 460 may output the input image data IDAT of N*MR frames as the output image data ODAT, and may not output the input image data IDAT of remaining N*(1−MR) frames, where N is an integer greater than 0, and MR is the masking ratio greater than 0 and less than or equal to 1. According to some example embodiments, in the still image mode, the adaptive refresh block 460 may determine a final masking ratio based on the target frequency, and may gradually decrease the masking ratio from 1 to the final masking ratio such that a frequency of the output image data ODAT is gradually decreased from a fixed input frequency (e.g., about 60 Hz) to the target frequency.

According to some example embodiments, as illustrated in FIG. 9, the adaptive refresh block 460 may include an image analysis block 162, a frequency decision block 164, a frequency mixing block 166 and a switch 468. Thus, compared with an adaptive refresh block 160 of FIG. 2, the adaptive refresh block 460 may further include the switch 468.

The image analysis block 162 may determine whether or not an image represented by the input image data IDAT is changed, the frequency decision block 164 may determine the target frequency based on a luminance distribution of the input image data IDAT, and the frequency mixing block 166 may determine the masking ratio based on the target frequency, and may selectively output the input image data IDAT as the output image data ODAT by performing the masking operation on the input image data IDAT with the masking ratio. In some example embodiments, when the image analysis block 162 determines that the image represented by the input image data IDAT is changed, the frequency decision block 164 may not decide the target frequency, and the frequency mixing block 166 may not perform the masking operation on the input image data IDAT, and may output the input image data IDAT as the output image data ODAT. In some example embodiments, the frequency mixing block 166 may determine a final masking ratio based on the target frequency, and may gradually decrease the masking ratio from 1 to the final masking ratio such that the frequency of the output image data ODAT is gradually decreased to the target frequency.

The switch 468 may receive the driving mode information MI, and may control a path of the input image data IDAT according to the driving mode represented by the driving mode information MI. For example, when the driving mode information represents the still image mode (e.g., the command mode), the switch 468 may allow the input image data IDAT to be provided to the image analysis block 162, the frequency decision block 164 and the frequency mixing block 166. Thus, in the still image mode (e.g., the command mode), the masking operation on the input image data IDAT, or the adaptive refresh may be performed. Further, when the driving mode information represents the moving image mode (e.g., the video mode), the switch 468 may allow the input image data IDAT to bypass the image analysis block 162, the frequency decision block 164 and the frequency mixing block 166 such that the input image data IDAT may be output as the output image data ODAT. Accordingly, in the moving image mode (e.g., the video mode), the masking operation on the input image data IDAT, or the adaptive refresh may not be performed.

As described above, the display device 400 according to some example embodiments may receive the driving mode information MI, may perform the masking operation when the driving mode information MI represents the still image mode (e.g., the command mode), and may not perform the masking operation when the driving mode information MI represents the moving image mode (e.g., the video mode). Accordingly, the power consumption of the display device 400 may be reduced in the still image mode, and the occurrence of the flicker may be prevented or reduced in the moving image mode.

Figure 10:
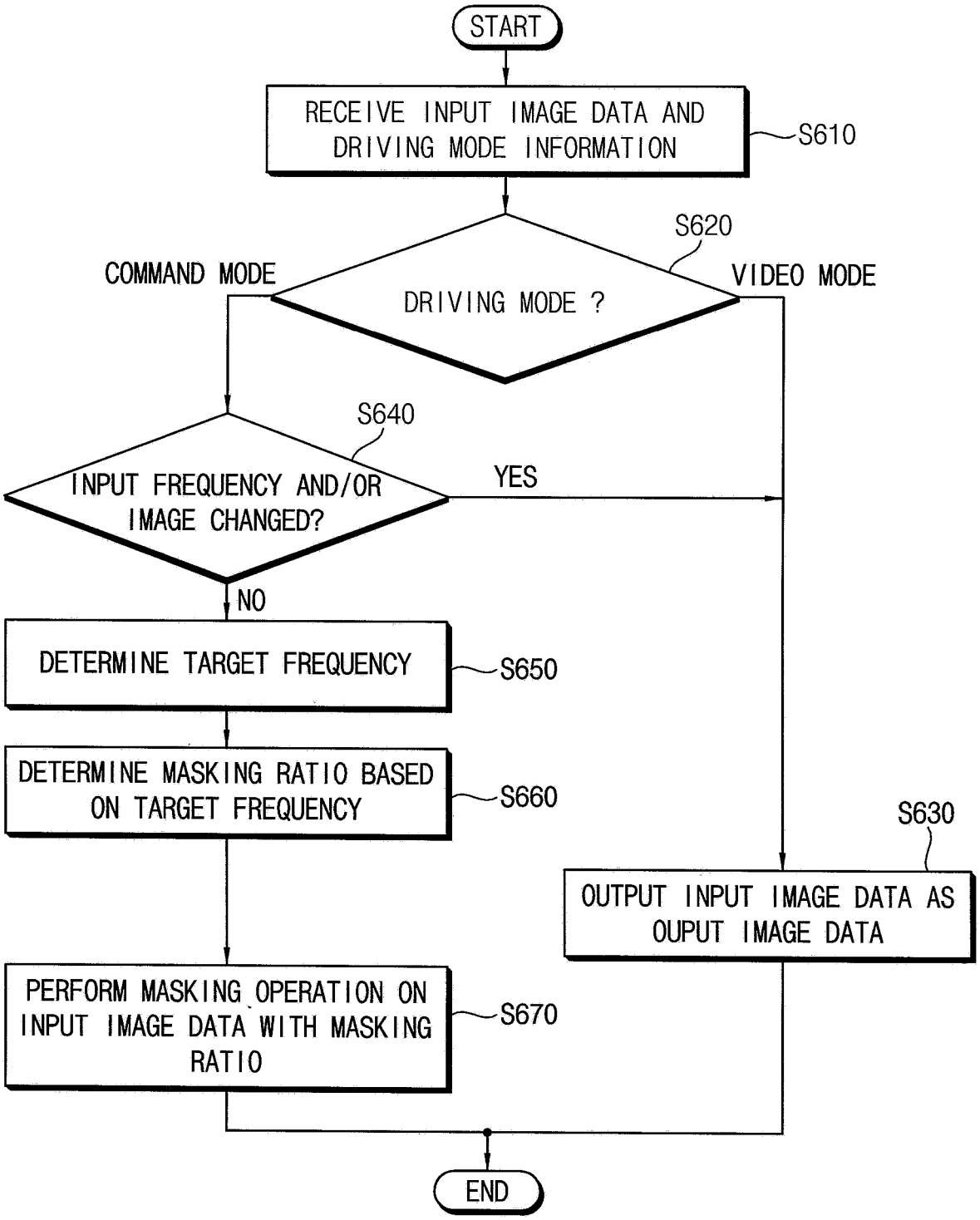
FIG. 10 is a flowchart illustrating a method of operating a display device according to some example embodiments.
Figure 11:
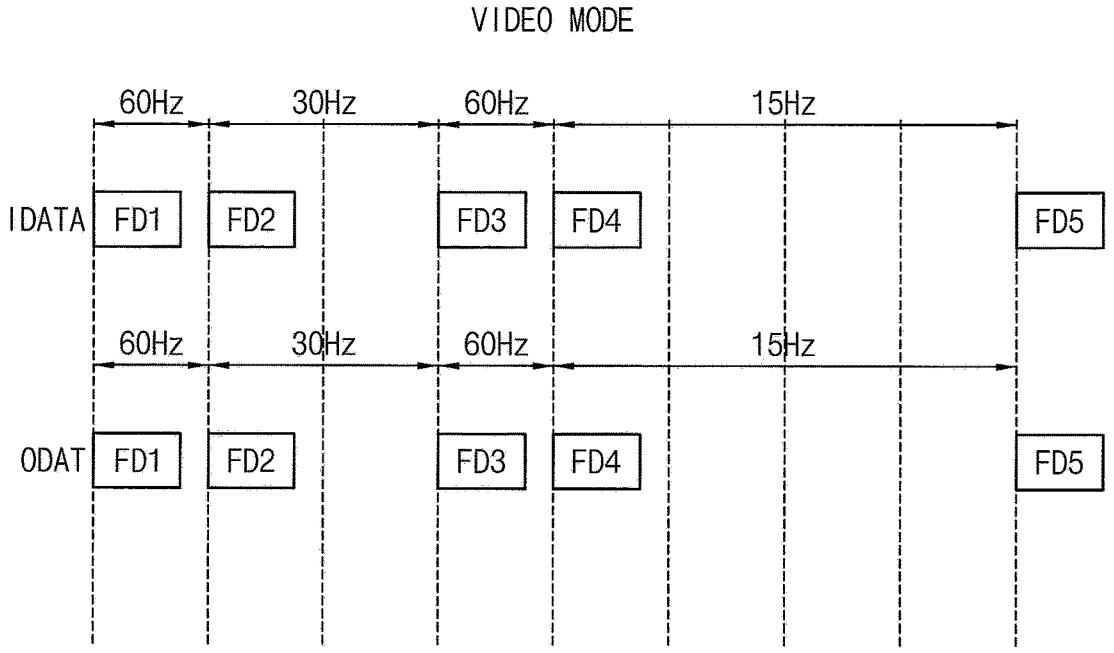
FIG. 11 is a diagram for describing an example of an operation of an adaptive refresh block in a video mode.
Figure 12:
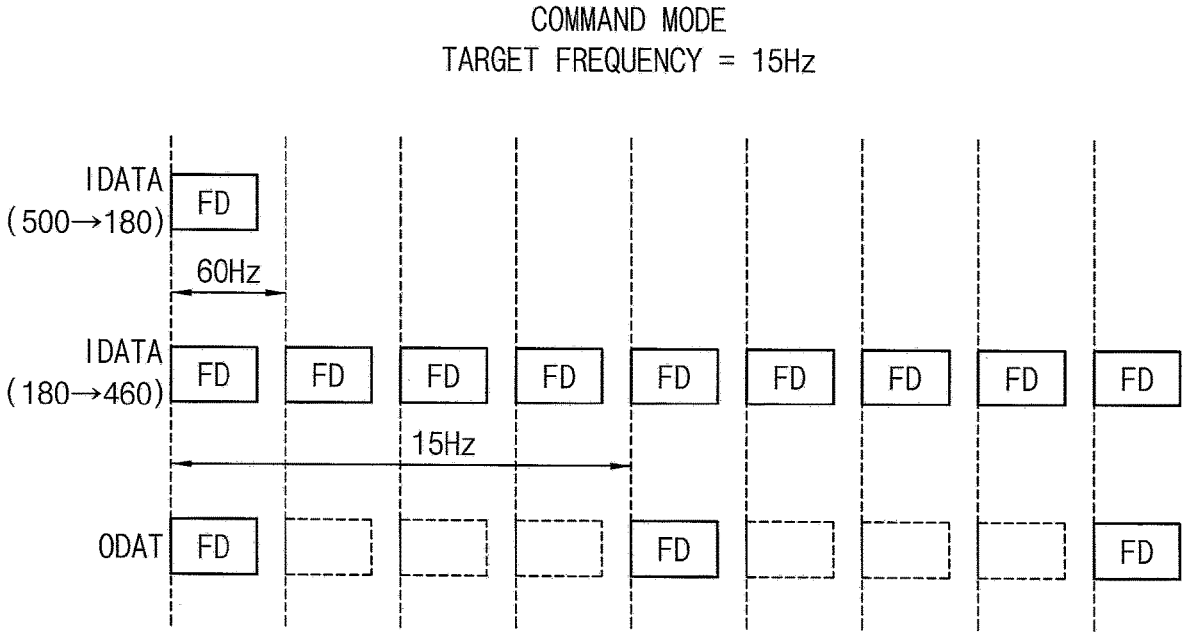
FIG. 12 is a diagram for describing an example of an operation of an adaptive refresh block in a command mode.

FIG. 10 is a flowchart illustrating a method of operating a display device according to some example embodiments, FIG. 11 is a diagram for describing an example of an operation of an adaptive refresh block in a video mode, and FIG. 12 is a diagram for describing an example of an operation of an adaptive refresh block in a command mode.

Referring to FIGS. 8 through 10, a controller 440 may receive input image data IDAT, and driving mode information MI representing a still image mode (e.g., a command mode) or a moving image mode (e.g., a video mode) from a host processor 500 (S610). A display device 400 may selectively perform adaptive refresh according to a driving mode represented by the driving mode information MI.

For example, in a case where the driving mode represented by the driving mode information MI is the video mode (S620: VIDEO MODE), the display device 400 may not perform the adaptive refresh. That is, an adaptive refresh block 460 may not perform a masking operation on input image data IDAT, and may output the input image data IDAT as output image data ODAT (S630). For example, as illustrated in FIG. 11, in a case where, as the input image data IDAT, first frame data FD1 are received at about 60 Hz, second frame data FD2 are received at about 30 Hz, third frame data FD3 are received at about 60 Hz, and fourth frame data FD4 are received at about 15 Hz, the adaptive refresh block 460 may output, as the output frame data ODAT, the first frame data FD1 at about 60 Hz, the second frame data FD2 at about 30 Hz, the third frame data FD3 at about 60 Hz, and the fourth frame data FD4 at about 15 Hz. Accordingly, the display device 400 may display an image at a frequency substantially the same as an input frequency of the input image data IDAT.

In a case where the driving mode represented by the driving mode information MI is the command mode (S620: COMMAND MODE), the display device 400 may perform the adaptive refresh as illustrated in FIG. 3 or FIG. 6. For example, the adaptive refresh block 460 may determine whether the input frequency of the input image data IDAT is changed, and/or whether an image represented by the input image data IDAT is changed (S640). When the input frequency of the input image data IDAT is changed or when the image represented by the input image data IDAT is changed (S640: YES), the adaptive refresh block 460 may output the input image data IDAT as output image data ODAT (S630). When the input frequency of the input image data IDAT is not changed and when the image represented by the input image data IDAT is not changed (S640: NO), the adaptive refresh block 460 may determine a target frequency based on a luminance distribution of the input image data IDAT (S650), may determine a masking ratio based on (a fixed input frequency and) the target frequency (S660), and may selectively output the input image data IDAT as the output image data ODAT by performing the masking operation on the input image data IDAT with the masking ratio (S670). For example, as illustrated in FIG. 12, in the command mode, frame data FD provided from the host processor 500 may be stored in a frame memory 180, and the adaptive refresh block 460 may receive the input image data IDAT at a fixed input frequency of about 60 Hz from the frame memory 180. Further, in a case where the target frequency determined by analyzing the frame data FD is about 15 Hz, the adaptive refresh block 460 may output one of four frame data FD. Accordingly, the display panel 110 may display (or refresh) an image at the target frequency of about 15 Hz lower than the fixed input frequency of about 60 Hz, and thus the power consumption of the display device 400 may be reduced.

Figure 13:
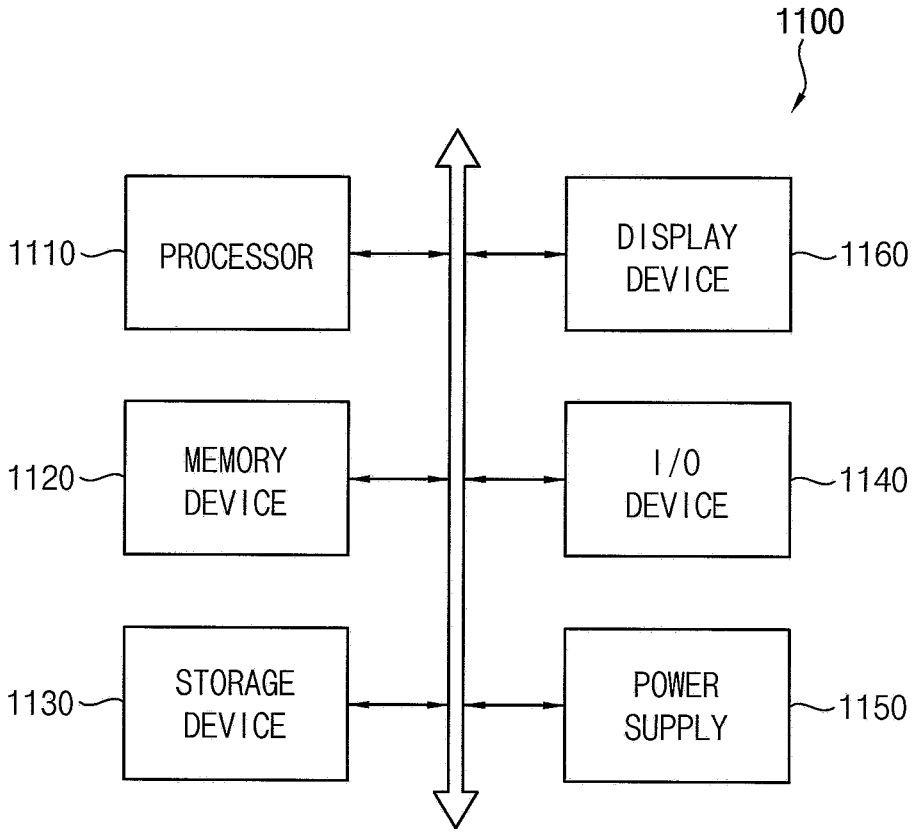
FIG. 13 is an electronic device including a display device according to some example embodiments.

FIG. 13 is an electronic device including a display device according to some example embodiments.

Referring to FIG. 13, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In some example embodiments, the display device 1160 may receive input frequency information representing an input frequency of input image data, may determine a masking ratio based on the input frequency represented by the input frequency information and a target frequency, and may perform a masking operation on the input image data with the masking ratio. Accordingly, even if the input frequency of the input image data is changed, the display device may perform the masking operation with the optimal masking ratio, and thus may perform adaptive refresh without an occurrence of a flicker. In other example embodiments, the display device 1160 may receive driving mode information, may perform the masking operation when the driving mode information represents a still image mode (e.g., a command mode), and may not perform the masking operation when the driving mode information represents a moving image mode (e.g., a video mode). Accordingly, the power consumption of the display device 1160 may be reduced in the still image mode, and the occurrence of the flicker in the moving image mode may be prevented or reduced.

The inventive concepts may be applied to any display device 1160, and any electronic device 1100 including the display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels;

a data driver configured to generate data voltages based on output image data, and to provide the data voltages to the plurality of pixels; and a controller configured to receive input image data and input frequency information from a host processor, and to provide the output image data to the data driver, wherein the controller is configured to:

determine a target frequency by analyzing the input image data;

determine a masking ratio based on an input frequency represented by the input frequency information and the target frequency;

selectively output the input image data as the output image data by performing a masking operation on the input image data with the masking ratio;

determine whether or not the input frequency of the input image data is changed, and whether or not an image represented by the input image data is changed; and in response to determining that the input frequency of the input image data is changed and also determining that the image represented by the input image data is changed based on a comparison of a representative value of previous frame data and a representative value of current frame data, not perform the masking operation on the input image data, and output the input image data as the output image data.

2. The display device of claim 1, wherein, among the input image data of N frames, the controller is further configured to output the input image data of N*MR frames as the output image data, and to not output the input image data of remaining N*(1−MR) frames, where N is an integer greater than 0, and MR is the masking ratio greater than 0 and less than or equal to 1.

3. The display device of claim 2, wherein the controller is further configured to generate a disable signal during a period of the remaining N*(1−MR) frames where the input image data are not output, and wherein the data driver is configured to be disabled in response to the disable signal.

4. The display device of claim 3, wherein the controller is further configured to perform data processing on the output image data, and disable the data processing in response to the disable signal.

5. The display device of claim 1, wherein the controller is further configured to:

determine the target frequency based on a luminance distribution of the input image data; and determine the masking ratio based on the input frequency represented by the input frequency information and the target frequency, and selectively output the input image data as the output image data by performing the masking operation on the input image data with the masking ratio.

6. The display device of claim 5, wherein the controller is configured to calculate a final masking ratio by dividing the target frequency by the input frequency, and to gradually decrease the masking ratio from 1 to the final masking ratio such that a frequency of the output image data is gradually decreased from the input frequency to the target frequency.

7. The display device of claim 1, wherein the controller is further configured to calculate the masking ratio by dividing the target frequency by the input frequency.

8. The display device of claim 1, wherein the controller is further configured to not perform the masking operation on the input image data, and is configured to output the input image data as the output image data, in response to the input frequency of the input image data being changed, or in response to an image represented by the input image data being changed.

9. The display device of claim 1, wherein the controller is further configured to calculate a final masking ratio by dividing the target frequency by the input frequency, and to gradually decrease the masking ratio from 1 to the final masking ratio such that a frequency of the output image data is gradually decreased from the input frequency to the target frequency.

10. The display device of claim 1, wherein the controller further includes:

a frame memory configured to store the input image data received from the host processor in a command mode, and wherein the controller is configured to receive the input image data from the frame memory in the command mode.

11. A display device comprising:

a display panel including a plurality of pixels;

a data driver configured to generate data voltages based on output image data, and to provide the data voltages to the plurality of pixels; and a controller configured to receive input image data and driving mode information from a host processor, and to provide the output image data to the data driver, wherein the controller is configured to:

in response to the driving mode information corresponding to a still image mode, selectively output the input image data as the output image data by performing a masking operation on the input image data;

determine whether or not an input frequency of the input image data is changed, and whether or not an image represented by the input image data is changed; and in response to the driving mode information corresponding to a moving image mode and determining that the input frequency of the input image data is changed and determining that the image represented by the input image data is changed based on a comparison of a representative value of previous frame data and a representative value of current frame data, output the input image data as the output image data without performing the masking operation on the input image data.

12. The display device of claim 11, wherein the controller is configured to, in the still image mode, determine a target frequency by analyzing the input image data, determine a masking ratio based on the target frequency, and selectively output the input image data as the output image data by performing the masking operation on the input image data with the masking ratio.

13. The display device of claim 12, wherein the controller is configured to, in the still image mode, among the input image data of N frames, output the input image data of N*MR frames as the output image data, and not output the input image data of remaining N*(1−MR) frames, where N is an integer greater than 0, and MR is the masking ratio greater than 0 and less than or equal to 1.

14. The display device of claim 12, wherein the controller is configured to, in the still image mode, determine a final masking ratio based on the target frequency, and gradually decrease the masking ratio from 1 to the final masking ratio such that a frequency of the output image data is gradually decreased to the target frequency.

15. The display device of claim 11, wherein the controller is further configured to:

determine a target frequency based on a luminance distribution of the input image data;

determine a masking ratio based on the target frequency, and selectively output the input image data as the output image data by performing the masking operation on the input image data with the masking ratio; and allow the input image data to be output as the output image data in response to the driving mode information representing the moving image mode.

16. The display device of claim 15, wherein the controller is configured to determine a final masking ratio based on the target frequency, and to gradually decrease the masking ratio from 1 to the final masking ratio such that a frequency of the output image data is gradually decreased to the target frequency.

17. The display device of claim 11, wherein the controller further includes:

a frame memory configured to store the input image data received from the host processor, wherein the still image mode is a command mode in which the controller is configured to receive the input image data stored in the frame memory, and wherein the moving image mode is a video mode in which the input image data are not stored in the frame memory and the controller is configured to receive the input image data from the host processor.

* * * * *